United States Patent [19]

Hackman

[11] Patent Number: 4,977,951

[45] Date of Patent: Dec. 18, 1990

[54] APPARATUS FOR FLOW CONTROL OF MOLTEN MATERIAL BY FORCE DETECTION

[75] Inventor: Lloyd E. Hackman, Worthington, Ohio

[73] Assignee: Ribbon Technology Corporation, Gahanna, Ohio

[21] Appl. No.: 462,794

[22] Filed: Jan. 10, 1990

[51] Int. Cl.[5] ..... B22D 11/06; B22D 11/18

[52] U.S. Cl. ..... 164/453; 164/450; 164/423; 222/67; 222/596

[58] Field of Search ..... 164/463, 479, 423, 429, 164/453, 457, 449, 450, 156; 222/67, 68, 319, 405, 594, 596

[56] References Cited

U.S. PATENT DOCUMENTS 3,478,808 11/1969 Adams .
3,522,836 8/1970 King .
3,605,863 9/1971 King .
3,921,697 11/1975 Petry .
4,276,921 7/1981 Lemmens et al. .
4,592,410 6/1986 Takamoto et al. .

*Primary Examiner*—Kuang Y. Lin
*Attorney, Agent, or Firm*—Frank H. Foster

[57] ABSTRACT

The invention is directed to an apparatus and method for controlling the overflow of molten material from a receptacle for the purpose of achieving more uniform casting of the molten material. The apparatus and method utilize a force detector able to detect the change in the buoyant force exerted on a submersible body lowered into a molten material. A differentiating means, a control means, and a drive means are responsive to the force detector, whereby a constant rate of change of buoyant force is translated into a uniform rate of overflow of molten material delivered to a heat extracting substrate for solidification.

26 Claims, 4 Drawing Sheets

GRAPH OF BUOYANT FORCE VS. DEPTH OF SUBMERSION OF THE SUBMERSIBLE BODY

APPARATUS FOR FLOW CONTROL OF MOLTEN MATERIAL BY FORCE DETECTION

FIELD OF THE INVENTION

This invention relates to an apparatus and method for the control of the overflow of molten material from a receptacle for the purpose of achieving more uniform casting of the molten material. More specifically, the invention relates to an apparatus and method utilizing a force detector able to detect the change in the buoyant force exerted on a submersible body lowered into a molten material.

BACKGROUND OF THE INVENTION

Conventional methods for the casting of metals by the overflow of molten metal include creating a flow of molten metal from a receptacle onto a cooling, moving, heat extracting substrate. In this manner, the metal is removed from the receptacle, solidified and spontaneously released from the surface of the substrate.

To obtain a uniform cast product having a given quality and dimensions, one must be able to pour or overflow the molten material at a controlled rate, i.e., to control the metal flow rate in a precise manner so as to keep it always constant in relation to the speed of removal of the solidified me&:al from the cooling, moving substrate.

Various methods have been utilized to control the uniformity of the molten material flow so that the solidified product has a desired uniformity. U.S. Pat. No. 3,522,836, issued Aug. 4, 1970 to King, and U.S. Pat. No. 3,605,863, issued Sept. 20, 1971 to King, teach a method and apparatus for manufacturing wire and the like by maintaining static equilibrium in molten material at the outlet of a nozzle to form a convex meniscus from which the material is continuously drawn off and solidified by means of a moving surface. The King patents utilize a piston which is driven downwardly into the molten material to force the molten material through a nozzle. The piston is driven in response to a signal from a relay switch which is activated by excitation of a relay. Two electrodes complete the electrical circuit in the King patents by the placement of one of the electrodes in the molten material and one electrode situated at the desired level above said molten material whereby when the level of the molten material reaches the second electrode the level is sufficient to flow out the nozzle. Furthermore, when the surface of the molten material rises to the desired level of the second electrode, electrical contact is made, closing the relay circuit, which stops a motor driving the piston. When, however, the surface of the molten metal is low, galvanic contact is interrupted, the relay is deenergized and the switch closes. The motor then turns on and the piston is driven downwardly, thereby raising the molten material level until the desired level of the second electrode is attained causing the motor to stop.

The method and apparatus of King, however, require an electrical conductivity through the molten material. The electrodes are subject to being partially dissolved in the melt or having melt solidify on them, either of which can change the effective location of the electrode and thereby change the melt level at which it activates the circuit. Furthermore, the King patents are not melt overflow procedures but are designed to drive molten material through a nozzle. Finally, the King patents do not rely on detection of changes in buoyant forces on the piston.

U.S. Pat. No. 4,592,410 shows a melt flow rate control system in which an entire tundish and its contents is weighed and the weight signal used to control a nozzle.

Other level control systems are shown in U.S. Pat. Nos. 3,478,808; 3,921,697; and 4,276,921.

SUMMARY OF THE INVENTION

The present invention relates to an apparatus and method for the control of the overflow of molten material from a receptacle for the purpose of achieving more uniform casting of the molten material, said apparatus and method utilizing a force detector able to detect the change in the buoyant force exerted on a submersible body lowered into the molten material. By the present invention, the practitioner is able to control the feed rate at which molten metal is delivered to a cooling substrate in a precise manner so as to keep it always constant in relation to the speed of removal of the solidified metal from the cooling, moving substrate.

In a batch embodiment of the invention a submersible body, preferably having a cylindrical shape, is lowered into the melt at a velocity which maintains a constant rate of change of buoyant force. In a continuous process embodiment, preferably having a conical submersible body, melt is poured into a casting receptacle at a rate which is controlled by maintaining the buoyant force constant.

DESCRIPTION OF THE FIGURES

The accompanying figures serve to further explain the invention but are not to be regarded as limitations thereof.

Figure 1:
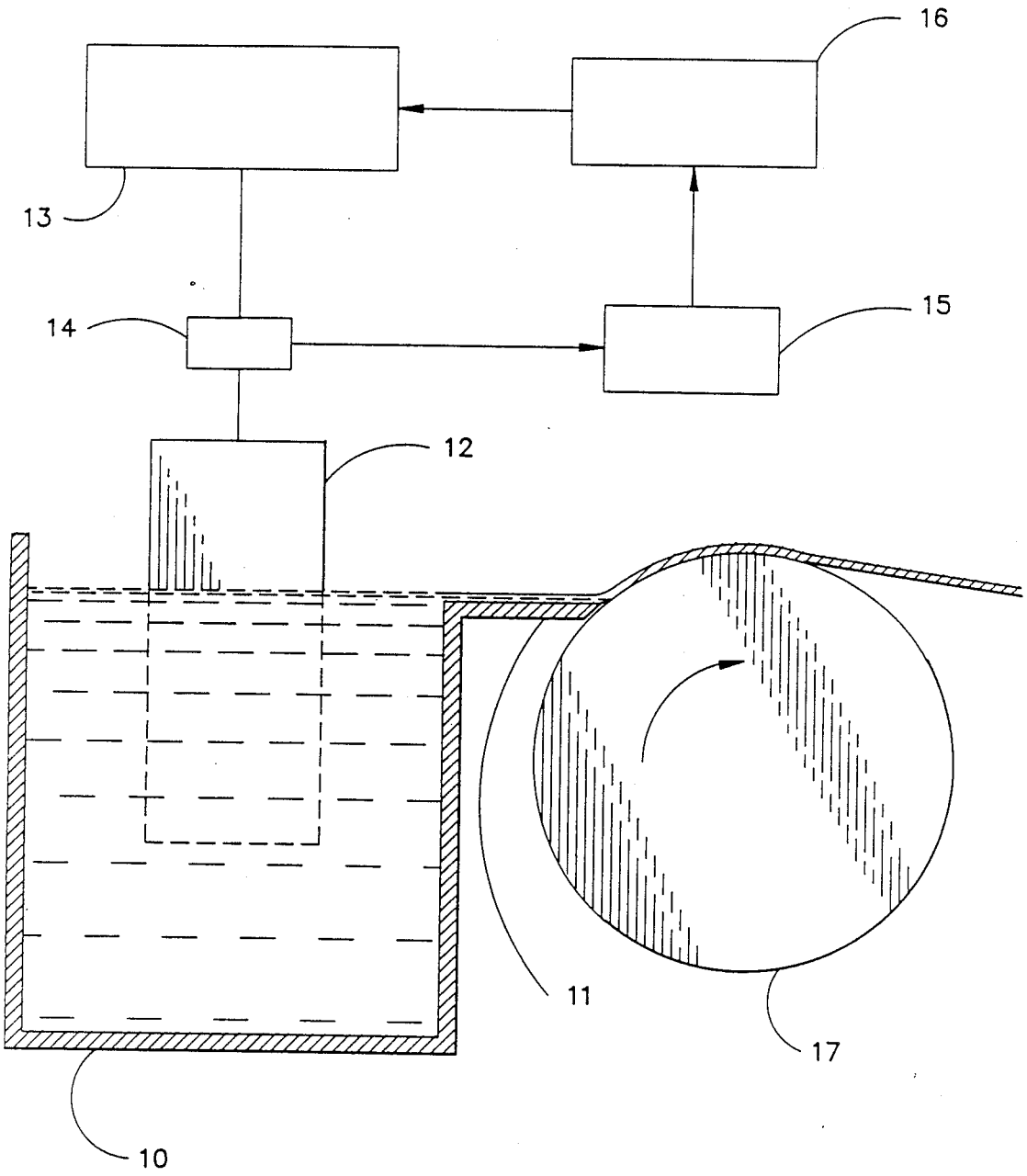
FIG. 1 is a vertical cross section of a batch wise embodiment.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The device represented in FIG. 1 comprises a reservoir or receptacle 10 for containing the molten material. The receptacle 10 has a lip 11 over which the molten material is caused to flow when displaced by the movably mounted submersible body 12. The movably mounted submersible body 12 is a buoyant body and can be any desired shape. It can have a negative or positive buoyancy and should be nonreactive with the molten material and remain solid at the melt temperature. There can be more than one buoyant body according to the present invention.

The submersible body 12 is drivingly linked to a drive means 13 which lowers or raises the submersible body 12. The submersible body 12 is also connected to an interposed force detector 14 which detects the difference between the downward gravitational force on the submersible body 12 and the upward buoyant force exerted on the body by the molten material. Since the gravitational force downward on the submersible body 12 is constant, changes in the force detected by the force detector 14 represent changes in the buoyant force or hydrostatic force exerted by the molten material on the body.

A differentiating means 15 for detecting the time rate of change of the force detected by the force detector 14 is connected to the force detector 14. Connected to the differentiating means 15 is a control means 16 which is responsive to the differentiating means 15 and serves to control the drive means 13 for lowering the submersible body 12. The control means 16 may be a general purpose digital computer conventionally programmed in accordance with the present invention or a special purpose device conventionally designed to accomplish the same function. The drive means 13 is responsive to the differentiating means 15 and, in response to the signal from the differentiating means 15, lowers the submersible body 12 into the molten material at a velocity which maintains a constant time rate of change of the buoyant force detected by the force detector 14. Together these components form a feedback control system. In this manner, in a steady state condition of operation, a constant rate of change of the detected force is produced which effects a constant rate of molten material flow over the lip 11 of the receptacle 10.

When the molten material leaves the lip 11, it contacts a rotating heat extracting substrate 17 which cools the molten material causing the material to solidify. The solidified material can be a sheet, film, fiber, wire or the like which is more uniform in dimensions than would be achievable in conventional melt overflow or nozzle-extrusion technologies.

Thus, the flow rate of the molten material and indirectly the level of the free surface of the molten material in the receptacle 10 are controlled by the submersible body 12 driven by the drive means 13. The drive means 13 is connected to the submersible body 12 by any conventional transmission, support, or linkage mechanism, such as a pulley mechanism, a hydraulic or pneumatic mechanism, or the like.

Under initial transient conditions before casting is initiated, the drive means 13 lowers the submersible body 12 into the molten material, the molten material is displaced, raising the level of the free surface of the molten material in the receptacle 10. As the level of the free surface of the molten material rises in the receptacle 10 and the depth of the submersible body increases, the buoyant force exerted on the submersible body 12 increases.

At some point, depending on the size and density of the submersible body 12, the buoyant force pushing upwardly on the submersible body 12 may become equal to the gravitational force pulling downwardly on the body. As the submersible body !2 is driven further into the molten material, the buoyant force continues to increase while the gravitational force remains constant. The difference between the constant gravitational force on the submersible body 12 and the changing buoyant force on the body is detected by the force detector 14.

When the level of the free surface of the molten material reaches the level of the overflow lip 11, the molten material flows out of the receptacle 10 over the lip 11 and contacts the rotating heat extracting substrate 17. As the submersible body continues to descend, the molten material is displaced over the lip 11 and the buoyant force exerted on the submersible body 12 continues to increase. The change in the buoyant force is detected by the device identified as the force detector 14, which devices are conventional and readily known to those skilled in the art. Increasing the depth of submersion of the submersible body 12 to achieve and maintain a constant rate of change of the buoyant force and thus a constant rate of change of displacement will result in a steady state constant flow rate of molten material over the lip 11. It is therefore desirabe to lower the submersible body 12 into the molten material so that the rate of change of the buoyant force, and thus the flow of molten material over the lip 11, is constant.

Thus the buoyant force tends to increase as the submersible body 12 is lowered into the molten material, but the buoyant force tends to decrease as the molten material is displaced over the overflow lip 11. The change in buoyant force is detected by the force detector 14, and maintained at a constant rate of change as detected by the differentiating means 15. This results in a constant rate s of displacement of molten material with the identical constant flow rate onto the substrate which equals the weight or volume of the strip being cast.

The ability to control the flow rate and therefore the mass rate of strip production permits the selection of two parameters, mass flow rate and substrate surface velocity, for control of the process. In general, as flow rate is decreased and as substrate surface velocity is increased, the thickness of the sheet or strip is reduced. Thickness is increased by inverse changes in these parameters. Typically, the relative values of substrate surface velocity and flow rate are selected and preset to give the desired experimentally determined or mathematically calculated thickness and both are maximized in order to maximize production rate. However, the production rate is limited by the need to maintain the product quality. For example, production rate is limited by the need for essentially all of the molten material to be solidified before the sheet or strip separates from the substrate. Therefore, cooling rate presents an upper limit on production rate.

The differentiating means 15 for detecting the time rate of change of the force detected by the force detector 14 is connected to the force detector 14. A preferred differentiating means 15 is a computer which can be programmed to recognize a specific range of buoyant forces characteristic of the molten material, the volume of the submersible body 12, and the desired overflow rate. Thus, the differentiation is a simple mathematical operation easily performed by a computer. The differentiating means 15 signals the control means 16 to lower, stop, or even raise the submersible body 12, or to change the rate of lowering of the submersible body 12.

As the molten material leaves the lip 11, it contacts a rotating heat extracting substrate 17 which causes the material to cool and solidify. In this manner is formed continuous or discontinuous filament, fiber, wire, sheet, and the like. The shape and length of the solidified product is determined by the texture and speed of rotation of the heat extracting substrate, according to techniques known to those skilled in the art.

According to the present invention, two or more submersible bodies can be simultaneously, and preferably independently, lowered into the molten material. When two or more bodies arc utilized, it is desirable but not required that they be of different sizes so that the larger body can be lowered for achieving larger changes in the level of the free surface, and whereby the smaller body can be used to make minor changes in the level. In this manner, gross and fine tuning of the rate of change of melt overflow is obtainable. When two or more submersible bodies 12 are utilized it is desirable, but not required, that they be connected to separate force detectors 14, control means 16, and drive means 13, although a common differentiating means 15 is preferrable.

The submersible body 12 can, for example, comprise a water cooled metal container with an outer lining of a refractory material. The submersible body 12 can also comprise a refractory ceramic material or graphite material able to withstand the temperatures of the molten material. The submersible body 12 can be hollow or solid.

In a preferred embodiment of the present invention, the submersible body 12 is cylindrical in shape. Under ideal steady state conditions, this allows the drive mechanism to move the submersible body downwardly at a constant velocity. However, other shapes such as, but not limited to, spherical, cuboidal, pyramidal, or oblong are also operative herein. The shape of the submersible body 12 or bodies is not a limitation herein, but a conical shape is another preferred embodiment. A conically shaped tip on a cylindrical or oblong submersible body 12 is also operative herein. Thus an obelisk would be an acceptable submersible body 12.

Another preferred embodiment of the present invention comprises a cylindrical submersible body 12 with a rounded or hemispheric tip. The rounded tip minimizes or eliminates the potential for chipping of the tip of the submersible body 12. However, in the present invention, chipping off of the submersible body 12 does not adversely effect the control of the overflow rate. If the chip remains submersed in the molten material in the receptacle 10, the total volume of submersible body 12 in the molten material for displacing molten material would remain constant. If the chip floats or flows out with molten material it represents only a momentary or transient defect after which the same selected flow rate of molten material continues to flow onto the substrate.

The present invention also relates to an improved method for controlling the flow rate of molten material being cast from a flow rate control apparatus having a receptacle 10 for containing a molten material, the receptacle 10 having a lip 11 over which the molten material can flow when its free surface is raised to a level above the lip 11, the method comprising: lowering a submersible body 12 into the molten material while detecting the rate of molten material displacement by the body, said body being lowered at a selected molten material displacement rate. Thus a molten material flow rate of, for example, 20 $cm^3$/second could be achieved over the lip 11 and maintained onto the heat extracting substrate 17.

A preferred embodiment of the invention relates to a method wherein the rate of change of the buoyant force upon the body is detected by measuring the corresponding force applied by the submersible body 12 to a body support (described below) and differentiating that force by the differentiating means 15. The differentiating means 15 then analyzes the force data, compares it to any predetermined value or algorithm, and signals the control means 16 to activate the drive means 13 accordingly.

According to the apparatus and method of the present invention, erosion of the lip 11 of the receptacle 10, which is a problem in controlling uniformity in the prior art, does not create a serious problem herein. If erosion of the lip II occurs, the flow rate would increase if the level of the free surface remained the same. However, with the present invention, the free surface level will automatically be lowered to accomodate the lower level of the lip because the present invention maintains the flow rate, not the level, constant. The system simply reaches a steady state constant flow rate at a lower free surface level.

In a similar but inverse manner, freezing of the molten material on the lip 11 would form a constriction tending to reduce the flow rate if the free surface level remained constant. However, with the present invention, the submersible body would continue to be lowered until a new steady state is reached at the same constant displacement rate (and lowering velocity in the case of a cylinder) at a higher free surface level always matching the rate of desired strip production.

The force detector 14 can comprise, but is not limited to an electronic load cell, several types of which are well known in the art. The force detector 14 can further comprise a string gauge, a force gauge, or a pressure gauge to measure the hydrostatic force trying to push the buoyant body 12 out of the molten material. The force detector 14 will preferrably measure tension and compression forces exerted on the submersible body 12.

Figure 2:
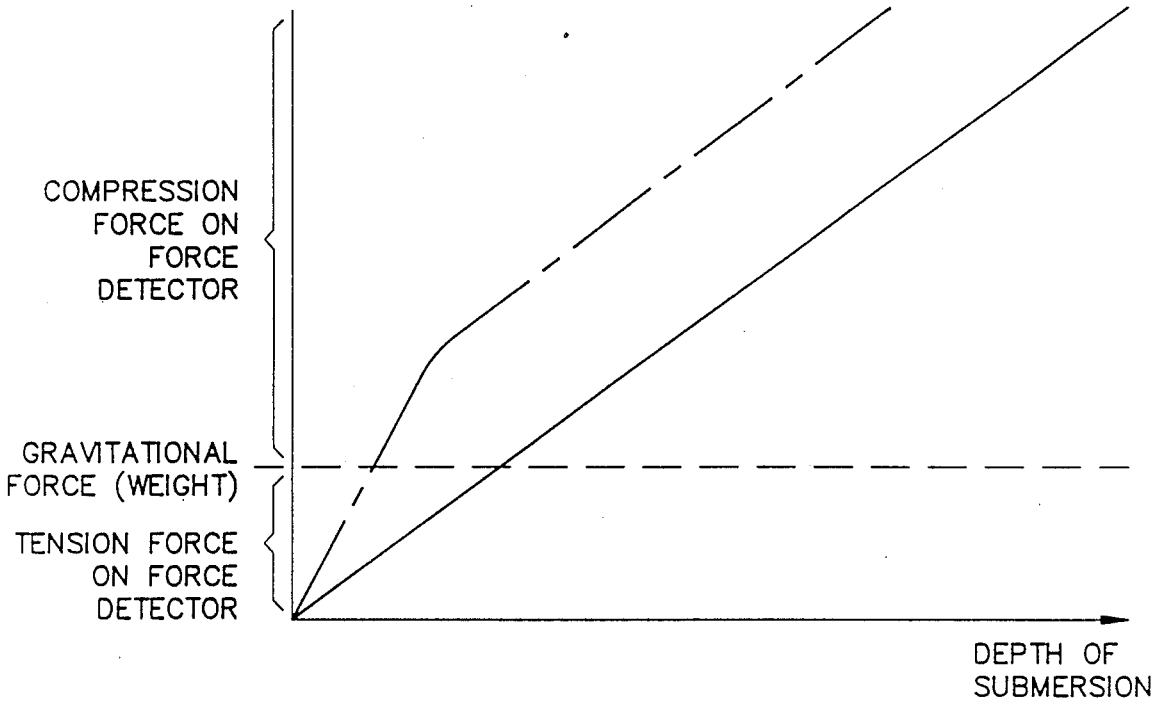
FIG. 2 is a graph of buoyant force vs. depth of submersion of the submersible body.

The differentiating means 15 can comprise, but is not limited to, an algorithm encoded on computer software, hardware, or within another form of computer memory. The preferred algorithm is $$\text{constant} = \frac{dF}{dt} = \frac{F_1 - F_2}{t_1 - t_2}$$

where $F_1$ is the buoyant force detected at time $t_1$ and $F_2$ is the buoyant force detected at time $t_2$. Thus the algorithm is an equation to determine the constant obtained by dividing change in the detected buoyant force by the change in time. As shown in FIG. 2, the graph of buoyant force vs. depth of submersion of the submersible body (or time) will be a straight line of equilibrium, the slope of which is constant matching a rate at which strip is being cast.

The differentiating means 15 can also comprise a programmable recorder, programmable controller, or a custom chip containing the algorithm. The differentiating means 15 can further include an analog to digital converter (A/D converter) which can convert an analog signal from the force detector 14 to a digital signal.

The control means 16 can comprise, but is not limited to, a digital to analog converter (D/A converter) to convert the computer digital signal to an analog signal to be sent to the drive means 13.

The drive means 13 can comprise, but is not limited to, an electric motor.

During operation of the method of the present invention, the submersible body 12 when first lowered into the molten material has not displaced enough molten material to cause the free surface level to rise to a level sufficient to overflow the lip 11. During this initial lowering of the submersible body 12, the gravitational force downward on the body will initially be greater than the buoyant force upward and thus it will be necessary for the body support parts attached to and supporting the submersible body 12, and the force detector 14, to hold or even pull up on the body. The body support parts can include the drive means 13, the force detector 14 and any other structures desired to hold the described components. During this initial lowering period, the net force is described as a negative force or pulling force on the body.

FIG. 2 illustrates the relationship between the change in the force on the body and the depth of submersion of the submersible body 12. As lowering of the body continues, eventually an equilibrium point may be achieved at which the buoyant force upward equals the downward gravitational force on the submersible body 12. Further lowering of the submersible body 12 creates a positive total force on the force detector 14 representing the excess of the buoyant force exerted by the molten material beyond the gravitational force. This increasing positive force is detected by the force detector 14 and, as shown in FIG. 2, is that rate of change in force necessary to achieve or maintain the desired constant pour or, overflow rate of molten material from the receptacle 10. As FIG. 2 illustrates, it is desirable that the slope of the graph be constant to thereby represent a uniform rate of change of the force and thus a uniform rate of overflow of molten material.

Although the same selected flow rate/displacement rate can be selected and used initially and during casting, it is advantageous to reduce the amount of scrap produced during the transition from start up to steady state. During this transition, the free surface level increases until the steady state flow rate is achieved. Since the transition produces scrap, it is desirable to reduce the transition time period to reach steady state sooner. This can be done by utilizing a higher selected flow rate during the transition so the submersible body is lowered at a higher velocity until the desired sheet product is produced. Then the selected flow rate/displacement rate is reduced to the desired flow rate for steady state production. This operation is illustrated as a phantom line in FIG. 1.

Thus, the present invention provides a method and apparatus for controlling the flow rate of the the overflow of molten material from a receptacle for the purpose of achieving more uniform casting of the molten material.

The method of the present invention could be a batchwise operation or a continuous operation. The batchwise operation would require, for example, that the submersible body 12 be lowered into the receptacle 10 until no more molten material could be caused to overflow the lip 11. Then more molten material would be added for the next batchwise step.

Figure 3:
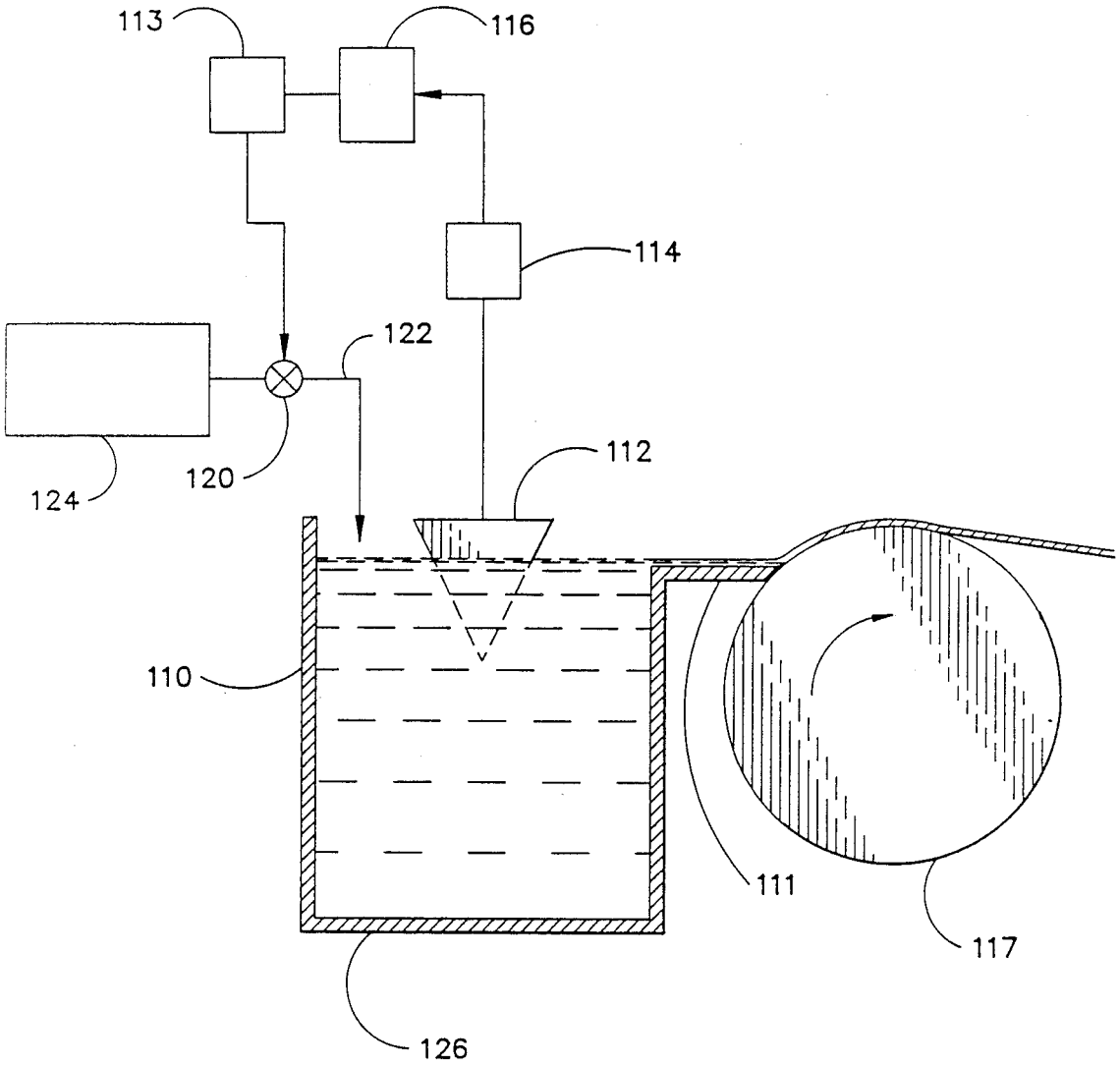
FIG. 3 is a vertical cross section of a continuous operation embodiment.

FIG. 3 illustrates another alternative structure which can be used for continuous process casting. In the embodiment of FIG. 3 a submersible body 112 is connected to a force detector 114 which in turn is connected to a control means 116. The control means 116 is in turn connected through a drive means 113 to control a valve means 120. The valve means 120 is in a supply conduit 122, connected at one end to a supply vessel 124 containing molten material. The valve means 120 may be a valve, a gate such as a slide gate commonly used to control molten metal flow rate or it may be a mechanism for tilting the supply vessel 124. The term "valve means" is used to generally designate a mechanism to control the flow of molten material which can be done by varying a constriction or flow path cross section or by tilting the supply vessel 124 more or less to respectively increase or decrease the flow of molten material. The other end of the supply conduit 122 extends into a receptacle 110 which contains the molten material 126. Casting is accomplished in this embodiment in the same manner as in the embodiment of FIG. 1, that is by overflowing molten material 126 over the lip 111 onto a rotating substrate 117.

This structure is essentially a level control means in which the force exerted on the body 112, which is partially submerged in the molten material 126, is detected by the force detector 114. The signal from the force detector 114 is applied to the control means 116 which is constructed in the conventional manner from the principles of the present invention. The control means 116 connecting through a drive means 113, which drives the valve means 120, adjustably opens or closes the valve means 120 in order to maintain a constant force upon the body 112.

Thus, the control means 116 simply increases the flow rate of molten material through the conduit 122 into the receptacle 126 by opening the valve means 120 further when the buoyant force exerted by the molten material 126 on the body 112 decreases below a selected set point. The control means 116 decreases the flow of molten material into receptacle 110 when that buoyant force increases above a selected set point.

Figure 4:
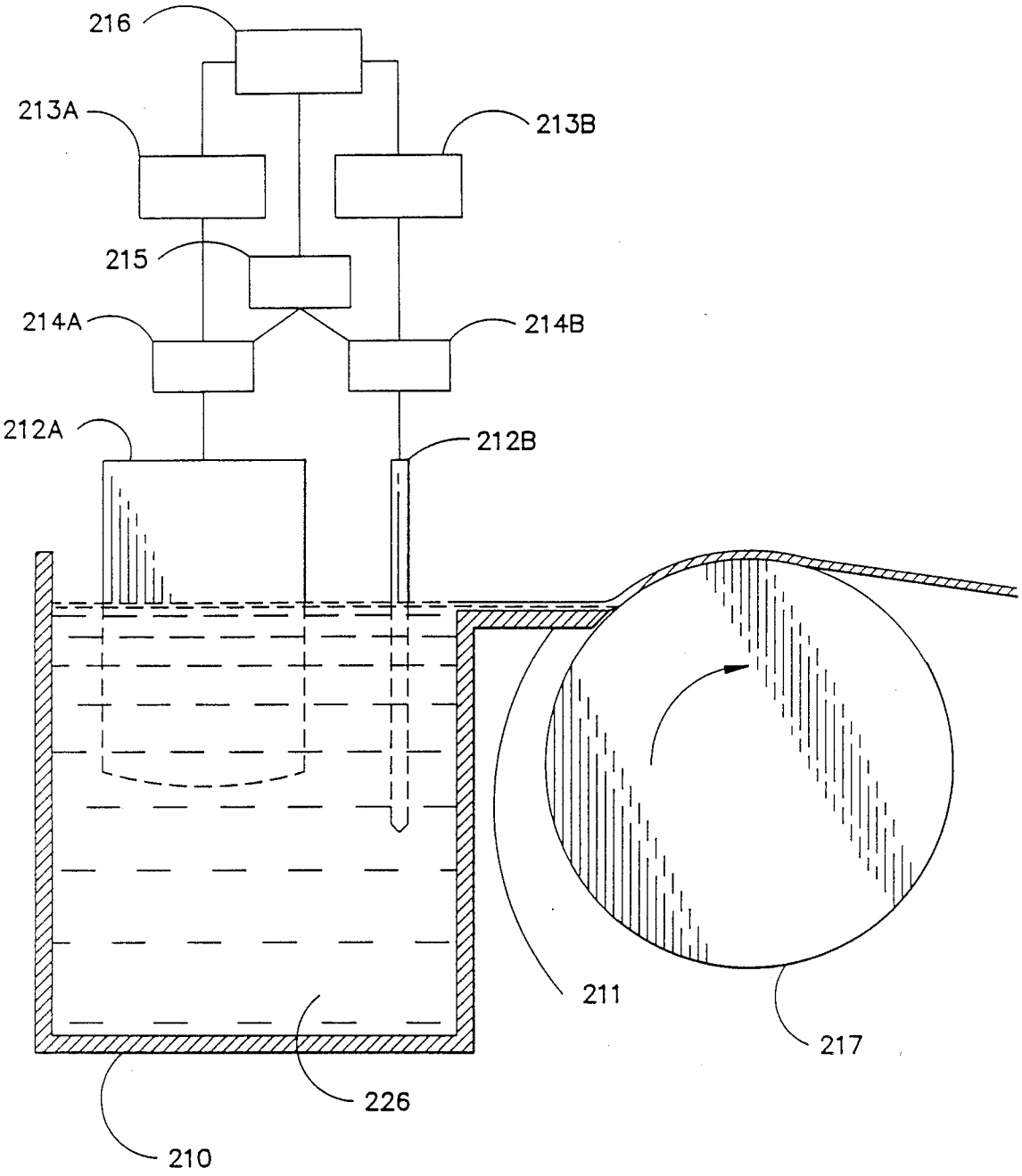
FIG. 4 is a vertical cross section of an embodiment with two submersible bodies and separate drive means and force detectors.

FIG. 4 illustrates another alternative structure which can be used for batchwise production. In the embodiment of FIG. 4 two submersible bodies, 212A and 212B optionally different in size and shape, are connected to force detectors 214A and 214B, respectively which in turn are both connected to a differentiating means 215, and to separate drive means 213A and 213B, respectively. The separate drive means 213A and 213B are connected to and responsive to signals from a common control means 216 which is also connected to the differentiating means 215. Casting is accomplished in this embodiment in the same manner as in the embodiment of FIG. 1, that is by overflowing molten material 226 over the lip 211 onto a rotating substrate 217.

Although specific embodiments of the invention have been disclosed herein in detail, it is to be understood that this is for purposes of illustration. This disclosure is not to be construed as limiting the scope of the invention, since the described method and apparatus may be changed in details by those skilled in the art in order to adapt them to particular casting machines, without departing from the scope of the following claims.

That which is claimed is:

1. A flow rate control apparatus for the casting of filaments and sheets, said apparatus having a receptacle for containing a molten material, the receptacle having a lip over which the molten material can flow when its free surface is raised to a level above the lip, the flow control apparatus comprising:

(a) at least one movably mounted submersible body mounted for lowering into and raising out of the molten material in the receptacle for variably displacing molten material;

(b) a drive means drivingly linked to the body for raising and lowering the submersible body;

(c) a force detector connected to the submersible body for detecting the force difference between the gravitational force and the buoyant force exerted on the body;

(d) a differentiating means for detecting the time rate of change of the force difference detected by the force detector; and (e) a control means responsive to the differentiating means and connected to control the drive means for lowering the submersible body at a rate which maintains a constant time rate of change of the force difference detected by the force detector whereby, in a steady state condition of operation, a constant rate of change of the detected force difference is produced which effects a constant rate of molten material flow over the lip from the receptacle.

2. The apparatus of claim 1 wherein the differentiating means for detecting the time rate of change of the force difference comprises a computer.

3. The apparatus of claim 1 wherein the differentiating means for detecting the time rate of change of the force difference further comprises an analog to digital converter.

4. The apparatus of claim 1 wherein the differentiating means for detecting the time rate of change of the force difference further comprises an algorithm encoded on computer software, hardware or custom chip.

5. The apparatus of claim 1 wherein the force detector is an electronic load cell.

6. The apparatus of claim 1 wherein the control means comprises a digital to analog converter.

7. The apparatus of claim 1 wherein the drive means comprises an electric motor.

8. The apparatus of claim 1 further comprising a movably mounted, heat extracting substrate spaced from the lip of the receptacle and mounted to be contacted by the overflowed molten material.

9. The apparatus of claim 8 wherein the substrate is a rotating, generally cylindrical drum or wheel.

10. The apparatus of claim 1 wherein there are two movable bodies which can be independently lowered into or raised out of the molten material in the receptacle, and wherein the bodies are independently connected to separate force detectors.

11. The apparatus of claim 10 wherein the movable bodies are cylindrical in shape and are of different sizes.

12. The apparatus of claim 1 wherein the submersible body . comprises a refractory ceramic material.

13. The apparatus of claim 1 wherein the submersible body comprises graphite.

14. The apparatus of claim 1 wherein the submersible body is a water cooled metal container with an outer lining comprising a refractory material.

15. The apparatus of claim I wherein the submersible body comprises a conical portion.

16. The apparatus of claim 1 wherein the submersible body comprises a hemispheric portion.

17. An improved method for controlling the flow rate of molten material being cast from a receptacle for containing a molten material, the receptacle having a lip over which the molten material can flow when its free surface is raised to a level above the lip, the method comprising:

lowering a submersible body into the molten material while detecting the rate of molten material displacement by the body, said body being lowered at a selected, instantaneous molten material displacement rate equal to the desired instantaneous flow rate.

18. A method in accordance with claim 17 wherein the body is lowered during a steady state equilibrium at a constant molten material displacement rate to effect a uniform flow rate over the lip which is equal to the constant molten material displacement rate.

19. A method in accordance with claim 17 or claim 18 wherein the displacement rate is detected by detecting the rate of change of the buoyant force upon the body.

20. A method in accordance with claim 19 wherein the rate of change of the buoyant force upon the body is detected by measuring the force applied by the body to a body support and differentiating that force.

21. A method in accordance with claim 18 wherein said body is initially lowered at a relatively higher displacement rate during an initial transition from no flow to a selected flow rate and thereafter the body is lowered at a relatively lower displacement rate for steady state casting.

22. The method of claim 17 further comprising contacting the overflowed molten material with a movably mounted, heat extracting substrate spaced from the lip of the receptacle, whereby the molten material solidifies to form filament or sheet material.

23. A level control apparatus for the casting of filaments and sheets, said apparatus having a receptacle for containing a molten material, the receptacle having a lip over which the molten material can flow when its free surface is raised to a level above the lip, the control apparatus comprising:

(a) a submersible body mounted to extend partially into the molten material in the receptacle;

(b) a force detector connected to the submersible body for detecting the force difference between the gravitational force and the buoyant force exerted on the body;

(c) a supply vessel containing molten material and having a supply conduit including a controllable valve means and arranged to supply molten material into the receptacle at a rate controlled by the valve means; and (d) a control means responsive to the force detector and connected to adjust the valve means to maintain a constant force on the force detector.

24. An apparatus in accordance with claim 23 wherein the submersible body is conical and arranged with its axis generally perpendicular to the free surface of the molten material.

25. An improved method for controlling the free surface level of molten material being cast from a receptacle having a lip over which the molten material can flow when its free surface is raised to a level above the lip, the method comprising:

detecting the force exerted by a body which is supported partially submersed in the molten material in the receptacle and supplying molten material into the receptacle at a rate which maintains that force constant.

26. A method in accordance with claim 25 wherein: a change in the detected force is due to a change in the buoyant force exerted on the body by the molten material and wherein the flow rate into the receptacle is increased when the buoyant force decreases below a selected force and is decreased when the buoyant force increases above a selected force.

* * * * *